United States Patent [19]

Sholl

[11] Patent Number: 4,921,517

[45] Date of Patent: May 1, 1990

[54] METHOD AND APPARATUS FOR DIRECTING GLASS FIBER STRANDS FOR FABRICATING CONTINUOUS STRAND, NONWOVEN MAT

[75] Inventor: Steven A. Sholl, Lancaster, Ohio

[73] Assignee: Superior Glass Fibers, Inc., Bremen, Ohio

[21] Appl. No.: 309,301

[22] Filed: Feb. 13, 1989

[51] Int. Cl.[5] ..... C03B 37/02

[52] U.S. Cl. ..... 65/4.4; 65/9; 156/167; 226/5; 226/6

[58] Field of Search ..... 65/4.4, 9; 156/167; 226/5, 6

[56] References Cited

U.S. PATENT DOCUMENTS

| | | | |
|---|---|---|---|
| 2,875,503 | 3/1959 | Frickert | 156/167 X |
| 3,511,625 | 5/1970 | Pitt | 65/4.4 X |
| 3,597,175 | 8/1971 | Pitt | 65/4.4 X |
| 4,046,538 | 9/1977 | Thomas | 65/4.4 |
| 4,601,741 | 7/1986 | Stotler | 65/4.4 |

*Primary Examiner*—Robert L. Lindsay

*Attorney, Agent, or Firm*—Frank H. Foster

[57] ABSTRACT

Glass fibers are projected along an oscillating trajectory onto a travelling conveyer to form a glass fiber mat. The trajectory is made to oscillate by stripping glass fibers from a pulling wheel by means of a stripping edge, such as a tight wire, which is oscillated arcuately immediately adjacent the surface of the pulling wheel. The stripping means is oscillated at a greater angular velocity where the trajectory makes a greater angle with the conveyer in order that the impingement point of the trajectory upon the conveyer travel at a substantially uniform velocity across the conveyer so that a mat of uniform density is fabricated.

10 Claims, 2 Drawing Sheets

METHOD AND APPARATUS FOR DIRECTING GLASS FIBER STRANDS FOR FABRICATING CONTINUOUS STRAND, NONWOVEN MAT

TECHNICAL FIELD

This invention relates generally to the fabrication of glass fiber, nonwoven mats, composed of strands of highly dispersed, continuous glass strands arranged in interengaging swirled relationship. More particularly, the invention relates to an improved method and apparatus for directing continuous glass strands onto a moving conveyer while simultaneously oscillating the strand impingement point laterally across the width of the conveyer at an essentially constant velocity.

BACKGROUND ART

Glass fiber mat has long been manufactured by directing continuous strands of glass fiber down onto a moving conveyer as the fiber trajectory and point of impingement is oscillated back and forth across the width of the conveyor. This builds up a random, homogeneous layer of interengaging strands in a swirled, overlapping arrangement. A variety of methods and apparatus for directing the glass fiber onto the moving conveyer have been attempted in the past several decades.

For example, U.S. Pat. No. 2,855,634 illustrates a plurality of continuous glass fiber strands directed onto a conveyer from a plurality of different pulling wheels distributed above the conveyer.

Others have suggested the deflection of a continuous glass fiber which is impinged upon a reflecting surface. Such patents include U.S. Pat. Nos. 2,736,676 and 4,345,927.

A more practical system for oscillating the trajectory of the glass strands utilizes a pulling wheel, having lateral slots through which the fingers of a finger wheel project. The finger wheel rotates about an axis of rotation which is offset from the axis of rotation of the pulling wheel. The fingers move out to release the strand from the pulling wheel so that it is projected along a substantially tangential path from the wheel to the moving conveyer. Structures of this type include those shown in U.S. Pat. Nos. 4,368,232 and 3,485,610.

Another system utilizes air blasts in place of the fingers, such as is illustrated in U.S. Pat. No. 2,450,916. The linear feed of a continuous multi-filament strand is illustrated in U.S. Pat. No. 2,935,179.

Finally, more recently, oscillating air current systems have been used for guiding a glass fiber along its trajectory and to cause the trajectory to oscillate back and forth laterally across the conveyer. Such systems are illustrated in U.S. Pat. Nos. 2,859,506; 2,875,503; 3,738,894; and 4,601,741.

One of the principal goals of a system for producing glass fiber mat is to fabricate a product exhibiting a uniform distribution of fibers randomly across the conveyer within the limits of the width of the finished glass fiber mat. Ideally, such a mat has a uniform density laterally from one edge, through the center, to the other edge of the mat and would terminate with relatively sharp lateral edges.

One difficulty with the air current systems is that the fibers flutter uncontrollably, providing little control of the curl and providing relatively ragged edges of nonhomogeneous density. Thus, the mat product is not sufficiently uniform near its edges. This necessitates that the mat be manufactured with an oversized width so that a strip of material can be removed from the opposite, lateral Substantial trim loss scrap is therefore produced.

A difficulty with the finger wheel systems is that the fingers create a small kink in each fiber and no control of the curl is permitted.

It is therefore an object and feature of the present invention to provide an apparatus and method which permits more accurate control of the glass fiber which is projected onto the conveyer without the inaccuracies caused by turbulent air currents or the deformities caused by the finger wheels.

A further object and feature of the present invention is to provide improved uniformity and density across the width of the glass fiber mat and also provide for control of the curl.

BRIEF DISCLOSURE OF INVENTION

In the present invention a glass fiber is directed onto a rotating pulling wheel which is rotating at an orientation in which tangents to the wheel intersect a support surface, such as a travelling conveyer. The fibers follow around the pulling wheel and are stripped from it by the edge of a stripping body which extends across the periphery of the pulling wheel and is reciprocating along a circular path adjacent to the periphery of the wheel. The stripping body, such as a tight wire, oscillates within an angular range at which tangents to the pulling wheel intersect the support surface so that glass fiber is stripped from the rotating pulling wheel and projected toward the support surface, substantially tangentially to the pulling wheel. Oscillation of the stripping body or wire causes oscillation of the fiber trajectory and therefore of the impingement point of the fiber upon the support surface.

Figure 1:
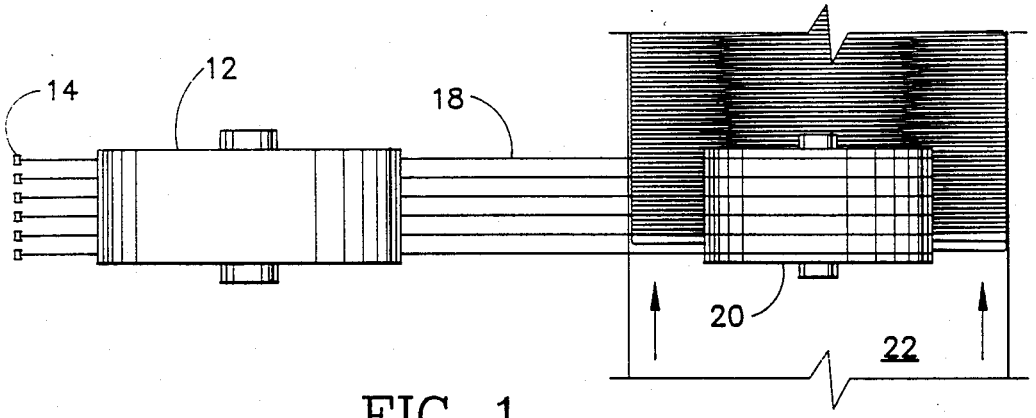
FIG. 1 is a diagrammatic top plan view of the preferred embodiment of the invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other circuit elements where such connection is recognized as being equivalent by those skilled in the art.

DETAILED DESCRIPTION

Figure 2:
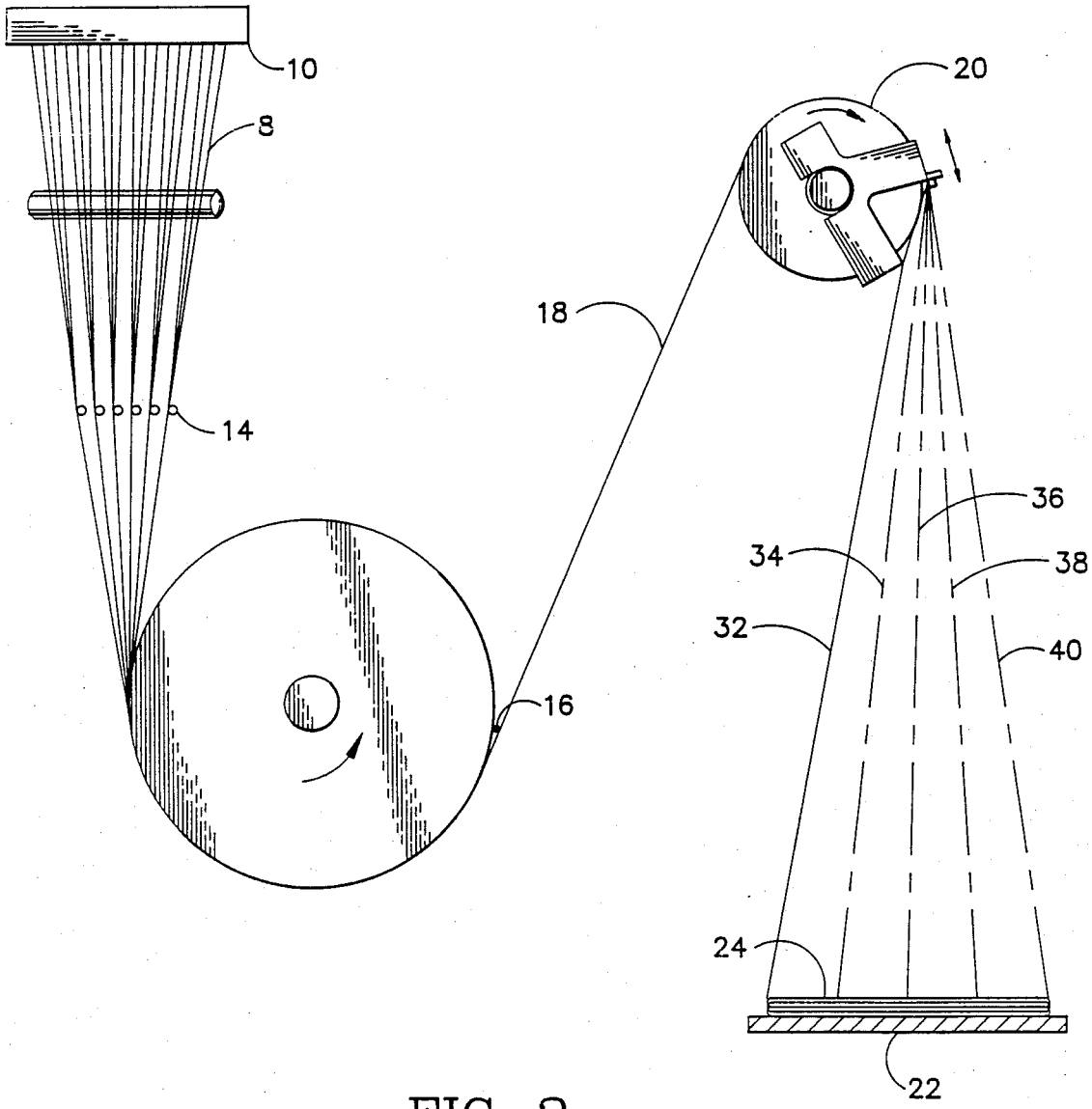
FIG. 2 is a view in side elevation of the embodiment of FIG. 1.

Referring to FIGS. 1 and 2, a plurality of molten glass fibers are drawn by a pulling wheel 12 from a plurality of orificed projections 10 which are conventionally formed on the bottom of a glass melting furnace. The fibers are pulled through shoes or rotating sheaves 14 and gathered into strands in the conventional manner.

For example, in the preferred embodiment of the invention, 300 filaments are gathered into 6 multifiber strands, each composed of 50 filaments per strand. The filaments 8 and the sheaves 14 are actually oriented in a plane which is parallel to the axis of rotation of the pulling wheel 12, but are diagrammatically illustrated otherwise for clarity.

The fibers are carried along the lower periphery of the rotating pulling wheel 12 until they are stripped in the conventional manner from the pulling wheel 12 by means of a wire 16 stretched tightly across the outer circular periphery of the pulling wheel 12. This causes the fibers 18 to be projected along a trajectory, substantially tangentially of the pulling wheel 12 and impinge upon a second pulling wheel 20.

The glass strands are carried around the second pulling wheel 20 and in accordance with the present invention are stripped from the pulling wheel 20 in a manner which causes them to be projected onto a conventional, foraminous, linked chain conveyer 22, positioned below the pulling wheel 20. They are projected in a manner which causes the strands to repetitively loop back and forth across the width of the conveyer 22 and build up a layer of stacked, intertwined strands to form the glass fiber mat. As the strands are built up, the conveyer 22 advances transversely to the lateral path of impingement of the fibers on the conveyer support surface 22.

Figure 3:
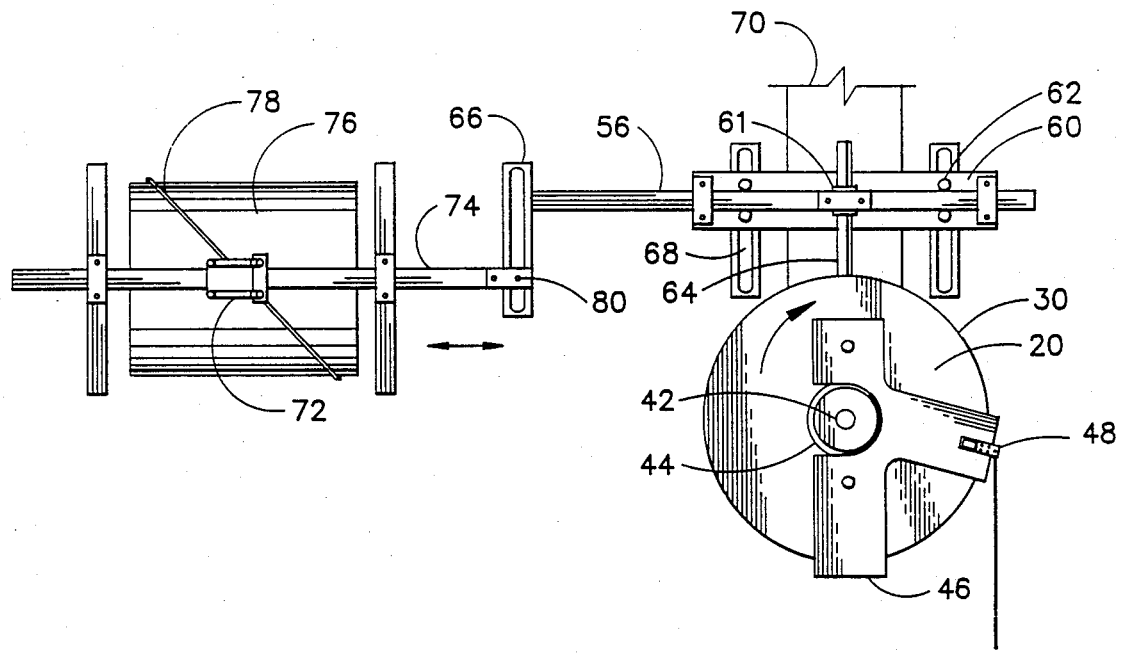
FIG. 3 is a side view in detail illustrating the principal components of the preferred embodiment of the invention.
Figure 4:
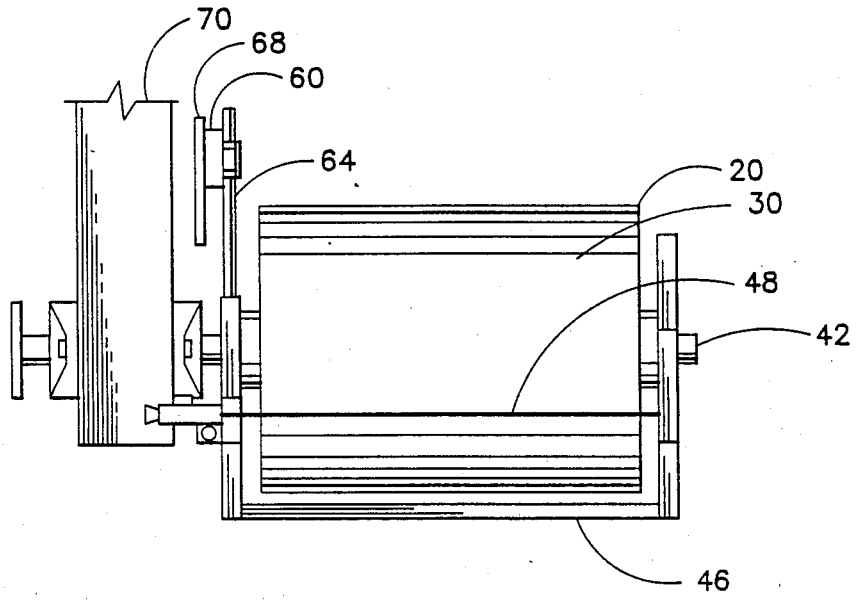
FIG. 4 is an end view of the embodiment illustrated in FIG. 3.

Referring now additionally to FIGS. 3 and 4 for detail, the pulling wheel 20 is rotatably driven by rotating drive means not illustrated, and has an outer, circular, peripheral surface 30. The pulling wheel 20 is oriented in a position so that tangents to the surface 30 of the pulling wheel 20 intersect the support surface 22 of the conveyer. This is illustrated in FIG. 2 for tangents 32, 34, 36, 38, and 40.

The rotating axle 42 of the pulling wheel 20 is journalled in a bearing 44. A bearing is also provided on a support frame 46 so that the support frame 46 is pivotable about the axis of rotation of the pulling wheel 20. The support frame 46 provides a stripping body support means which movably supports a wire 48, or other stripping body. This stripping body 48 is supported tightly across the peripheral surface of the pulling wheel 20, transverse to the fiber travel direction on the peripheral surface 30 and preferably parallel to the axis of rotation of the pulling wheel 20. The stripping body support frame 46 is pivotable so that it can reciprocate the stripping wire 48 along an arcuate path adjacent to the peripheral surface 30 of the pulling wheel 20. The wire 48, or other stripping body with a suitably thin edge which can function equivalently, reciprocates within an arc from which tangents to the wheel 20 intersect the support surface of the conveyer 22.

A drive means is linked to the stripping body support frame 46 for driving the stripping body wire 48 in its arcuate reciprocation. The drive means includes a rotating drum 76 around which there is a thick band 78 forming a cam. The band 78 encircles the drum 76 in a diagonal manner, directed one way in the first 180° of rotation and the opposite way in the remaining 180° of rotation, to form a closed loop. A follower 72 is attached to a reciprocating drive bar 74 and follows the reciprocating left and right apparent linear displacement of the band 78. A bolt 80 is attached to the reciprocating drive bar 74 and extends slidably through a slot 66 formed at the end of a second drive bar 56. This allows the drive bar 74 to drive the reciprocating drive bar 56 in linear reciprocation transverse to a radial of the axis of reciprocation of the stripping body support frame 46. The reciprocating drive bar 56 is mounted in a slide arrangement which includes a mounting plate 60 and bearings 62.

The stripping means support frame 46 also includes a radial bar 64 that extends into a pivoting sleeve 61 which pivots about a transverse axis to remain parallel to the radial bar 64, while allowing free coaxial movement. The series of slots 66 and 68 and sleeve 61 allow for repositioning and vertical adjustment of the mounting plate 60 and the reciprocating drive bar 56. The adjustment changes the distance between the reciprocating drive bar 56 and the center of rotation of the stripping means support frame 46, thus effectively changing the angular range of the arc in which the stripping body 48 travels along the peripheral surface 30.

Preferably, the radial bar 64 and the reciprocating drive bar 56 are relatively aligned so that the reciprocation path of the drive bar 56 is perpendicular to the radial bar 64 when the stripping body or wire 48 is intermediate the bounds of its arcuate reciprocation.

The rotating drum 76 and follower 72 are arranged to reciprocate the drive bars 74 and 56 at a substantially constant velocity. This occurs when the drum 76 rotates and the follower 72 follows the reciprocating left and right apparent linear displacement of the band 78. For every half revolution of the rotating drum 76 the follower 72 will travel from one extreme end of the band 78 to the opposite end. Thus, as the rotating drum 76 rotates, for example clockwise as viewed from the left end in the drawing, the follower 72 will move first to the left, then, as the band's 78 direction reverses, to the right. Similarly, when the follower 72 reaches the extreme right end of the band 78, where the band's 78 direction reverses again, the follower 72 will begin it's leftward motion, thus initiating repetition of the reciprocation of the drive bar 56.

In the operation of the preferred embodiment illustrated in the drawings, the glass fibers travel around the peripheral surface of the pulling wheel 20 until they strike the stripping body 48. Upon striking the stripping body they are stripped from the outer peripheral surface of the pulling wheel 20 and their momentum carries them along a trajectory which is substantially tangential to the peripheral surface of the pulling wheel 20 at the point they separated or restrict from that surface. Thus, as the stripping wire 48 reciprocates arcuately within an angle, the tangential trajectory of the fiber oscillates back and forth across the conveyer within the range illustrated in FIG. 2.

With the reciprocating drive bar 56 driven at a constant velocity, the stripping body is reciprocated at an angular velocity which is an increasing function of the angle between the support surface and the substantially tangential fiber trajectory along which the fiber travels to impinge upon the support surface. To accomplish this, the angular velocity of the stripping wire 48 is greatest where the fiber trajectory is making the maximum angle with the conveyer. For example, if the stripping wire 48 is centered directly above the support surface of the conveyor 22, the angular velocity is greatest when fiber is being directed straight down upon the support surface. The stripping wire moves at a slower angular velocity at a lesser angle between the trajectory and the support surface of the conveyer 22, that is, in the above example, when fiber is being directed toward the edges of the support surface.

The structural relationships of the illustrated embodiment cause a constant velocity traverse of the point of impingement of the fiber on the support surface back and forth across the conveyer to deliver the fiber at a uniform, homogeneous density laterally across the support surface.

There can be for example an angular reciprocation of + and −30 degrees. At +30° and at −30° the tangents intersect point B. Intermediate those positions the tangent intersects point A. If the approximation is made, that all tangents between plus and minus 30 degrees fall at the identical point between points A and B, then it can be shown from conventional geometry and trigonometry that the relationship of the velocity of the reciprocating bar 56 to the velocity of the impingement point of the fibers laterally along the support surface or conveyer is given by the following equation:

$$V_1=[d_o/r_o]V_2$$

where $d_o$ equals the perpendicular distance from the stripping wire 48 to the conveyer support surface 22;

$r_o$ equals the radius from the axis of rotation of the support frame 46 to the center of the pin 66 at the center of the arc of reciprocation of the support frame 46;

$V_2$ equals the linear velocity of the reciprocating drive bar 56; and the $V_1$ equals the linear velocity of the point of impingement of the tangential trajectory of the glass fibers upon the conveyer.

If the above approximating assumption is not made, then the relationship is as follows:

$$V_1=[d_o/r_o]V_2-Y_o[\sin\alpha/\cos^2\alpha]$$

where alpha is the angle of reciprocation from the center of the arc of reciprocation to the boundaries.

Mathematical analysis of these equations makes it apparent that the velocity of the tangential trajectory of the impingement of the glass fiber on the mat is approximately proportional to the velocity of the reciprocating drive bar 56. The approximation becomes more accurate as the angle of reciprocation becomes less.

Other linkages may also be developed for similarly causing the impingement point of the fibers on the conveyer to traverse laterally across the conveyer at a constant velocity.

One advantage of the invention is that the cycle rate or frequency of the oscillating fiber trajectory can be controlled and varied. This allows control of the curl size and along with conveyer speed, control of the density.

While certain preferred embodiments of the present invention have been disclosed in detail, it is to be understood that various modifications may be adopted without departing from the spirit of the invention or scope of the following claims.

What is claimed:

1. A method for directing a continuous glass fiber onto a support surface for forming a non-woven mat, the method comprising:

(a) directing the fiber onto a pulling wheel which is rotating at an orientation in which tangents to the wheel intersect the support surface; and (b) stripping the fiber from the wheel by reciprocating an edge of a stripping body, which is oriented transverse to the fiber travel direction, along a circular path adjacent the periphery of the wheel within an angular range at which tangents to the wheel intersect the support surface;

whereby the fiber is projected substantially tangential to the wheel to the support surface along an oscillating trajectory.

2. The method of claim 1 wherein the stripping body is reciprocated at an angular velocity which is an increasing function of the angle between said support surface and the fiber impinging on the support surface.

3. The method of claim 1 wherein said stripping body is reciprocated at an angular velocity at which the point of impingement of the glass fiber traverses the support surface at a substantially constant velocity across said support surface.

4. The method of claims 1 or 2 or 3 wherein the support surface is a conveyer moving substantially transverse to the path of impingement of the fibers on the support surface.

5. An improved apparatus of the type for forming a nonwoven continuous strand mat by directing a continuous, glass fiber onto a support surface, the improvement comprising:

(a) a first, rotatably driven pulling wheel having an outer, circular peripheral surface and mounted in an orientation in which tangents to the wheel intersect the support surface;

(b) means for directing at least one glass fiber onto said pulling wheel;

(c) a stripping body having a thin edge extending across the peripheral surface of the wheel transverse to the fiber travel direction on the peripheral surface;

(d) stripping body support means for movably supporting the stripping body to permit its edge to reciprocate along an arcuate path adjacent to the peripheral surface of the wheel within an arc from which tangents to the wheel intersect said support surface; and (e) drive means linked to said stripping body support means for driving said stripping body in said arcuate reciprocation.

6. An apparatus in accordance with claim 5 wherein said stripping body comprises a linear wire.

7. An apparatus in accordance with claim 5 or 6 wherein said stripping body support means comprises:

a support frame mounted for pivotable reciprocation about the axis of rotation of the pulling wheel, the support frame being attached to and supporting the stripping body on a radial of said axis of rotation.

8. An apparatus in accordance with claim 7 wherein said drive means comprises a drive bar which is driven in linear reciprocation transverse to a radial of said axis of reciprocation and wherein a radial bar is attached to the support frame and is linked to the drive bar by a pivoting sleeve which is attached to the drive bar and through which the radial bar extends.

9. An apparatus in accordance with claim 8 wherein the reciprocation path of the drive bar is perpendicular to said radial bar when the stripping body is intermediate the bounds of its arcuate reciprocation.

10. An apparatus in accordance with claim 9 wherein said drive means comprises:

(a) a rotating cylinder;

(b) a band, positioned in a diagonal manner around said rotating cylinder to form a closed loop; and (c) a following device, positioned on said band, which follows the reciprocating linear displacement of the band for driving said drive bar at a substantially constant velocity.

* * * * *